US005312282A

United States Patent [19]

Cooper

[11] Patent Number: 5,312,282

[45] Date of Patent: May 17, 1994

[54] BABY BOTTLE AND BIB STRUCTURE

[76] Inventor: Lynn Cooper, 219 Willis, Royal Oak, Mich. 48067

[21] Appl. No.: 872,452

[22] Filed: Apr. 23, 1992

[51] Int. Cl.[5] ..... A63H 3/33; A63H 33/00

[52] U.S. Cl. ..... 446/27; 446/74; 215/11.1; 2/49.2; 2/912

[58] Field of Search ..... 446/26, 27, 73–77, 446/81, 297, 475, 227; 220/527; 215/11.1, 11.6, 6; 2/49 R, 49 A

[56] References Cited

U.S. PATENT DOCUMENTS

| | | | |
|---|---|---|---|
| D. 67,140 | 4/1925 | Dupont . | |
| D. 145,611 | 9/1946 | Butterfield . | |
| D. 165,235 | 11/1951 | Miller . | |
| D. 184,455 | 2/1959 | Palmer . | |
| D. 189,012 | 10/1960 | Sepe et al. . | |
| D. 287,636 | 1/1987 | Callju . | |
| D. 305,346 | 1/1990 | Kimball | 2/49 R |
| 298,985 | 5/1884 | Roberts . | |
| 378,752 | 2/1888 | Ader | 215/6 |
| 1,589,138 | 6/1926 | Fisk . | |
| 2,162,998 | 6/1939 | Fisher | 446/74 X |
| 2,409,820 | 10/1946 | Zimmern . | |
| 2,547,312 | 4/1951 | Genovese | 446/74 X |
| 2,631,288 | 3/1953 | Daust | 2/49 R |
| 3,258,873 | 7/1966 | Franco | 446/81 |
| 3,521,397 | 7/1970 | Meates | 446/74 |
| 4,076,139 | 2/1978 | Larson . | |
| 4,249,338 | 2/1981 | Wexler . | |
| 4,710,145 | 12/1987 | Hall Vandis . | |
| 4,710,979 | 12/1987 | Bull et al. | 2/49 R |
| 4,898,060 | 2/1990 | To | 446/227 X |
| 4,934,542 | 6/1990 | Clark, Jr. . | |
| 4,944,704 | 7/1990 | Grace . | |
| 4,971,211 | 11/1990 | Lake . | |

*Primary Examiner*—Danton D. DeMille

*Attorney, Agent, or Firm*—Gifford, Groh, Sprinkle, Patmore and Anderson

[57] ABSTRACT

The invention relates to a baby bottle structure forming a doll. The baby bottle comprises a central fluid receptacle having a nipple portion at one end and a bottom portion at the opposing end. A removable cover is snapped about the nipple portion and forms the head of a doll. A removable bottom portion is attachable to the central fluid receptacle of the bottle and creates the feet portion of the doll. The feet of the doll are formed in such a way as to support the bottle in an upright position. The removable bottom support structure houses a music module that may be activated by tilting the baby bottle. The bottom portion also provides a housing for enclosing an independent pacifier. Thus, the baby bottle forms a musical doll and provides means for carrying a pacifier within its body structure. A bib is provided with the baby bottle doll and supports the baby bottle about the neck of an infant. A rattle or rattles may be removably attachable to the bib and form arms of the doll.

5 Claims, 3 Drawing Sheets

BABY BOTTLE AND BIB STRUCTURE

BACKGROUND OF THE INVENTION

I. Field of the Invention

The present invention relates generally to a baby bottle structure. More particularly, the present invention relates to a baby bottle structure forming a doll. A bib supports the bottle structure about an infant and simultaneously represents clothing for the doll.

II. Description of the Relevant Art

A baby bottle structure having a central fluid receptacle and upper nipple is generally available to consumers for feeding infants. The bottle structure is simple and, as such, has not changed in form for several decades.

A disadvantage of these previous bottle structures is that little or no support is provided by the bottle to aid an infant in feeding him or herself. Therefore, an infant must depend on an adult to support the bottle in the infant's mouth until such time as the infant is strong enough to hold the bottle independently.

A further disadvantage of the standard baby bottle structure is that it performs a single function only. Therefore, it is necessary to purchase independently pacifiers, toys or dolls, and baby bottles for an infant. This becomes especially cumbersome where it is necessary to gather up all of these articles in order to travel with the infant.

SUMMARY OF THE PRESENT INVENTION

The invention relates to a baby bottle structure forming a doll. The baby bottle comprises a central fluid receptacle having a nipple portion at one end and a bottom portion at the opposing end. A removable cover is snapped about the nipple portion and forms the head of a doll. A removable bottom portion is attachable to the central fluid receptacle of the bottle and creates the feet portion of the doll. The feet of the doll are formed in such a way as to support the bottle in an upright position. Thus, an advantage of this baby bottle structure is that the bottle is self-supporting.

The removable bottom support structure houses a music module that may be activated by tilting the baby bottle. The bottom portion also provides a housing for enclosing an independent pacifier. Thus, the baby bottle forms a musical doll and provides means for carrying a pacifier within its body structure.

A bib is provided with the baby bottle doll and supports the baby bottle about the neck of an infant.

The bottle may be supported by the bib simply by the use of a pocket removably attached to the bib or other means of support to form clothing for the baby bottle structure. A rattle or rattles may be removably attachable to the bib and form arms of the doll. Thus, the overall structure of the baby bottle comprises a solitary unit for providing a doll having a pacifier, rattles, musical means and a bib for supporting the doll about an infant.

A further advantage of this baby bottle structure is that it aids traumatized infants, such as blind infants, in feeding themselves. The music module and bib aids the blind infant in determining the location of the bottle itself. The feet of the doll help support the bottle in an upright position, preventing the bottle from rolling away from the blind infant. The ability of the bottle to support a pacifier allows the blind infant to seek out the pacifier without the aid of an adult. Further, the detachable clothing and rattles are easily accessible to the blind infant.

Other advantages and features of the present invention will become more apparent from the following detailed description when read in conjunction with the accompanying drawings.

BRIEF DESCRIPTION OF THE DRAWING

The present invention will be more fully understood by reference to the following detailed description of the preferred embodiment of the present invention when read in conjunction with the accompanying drawing, in which like-referenced characters refer to like-parts throughout the views, and in which.

DETAILED DESCRIPTION OF THE PREFERRED EMBODIMENT OF THE PRESENT INVENTION

Figure 1:
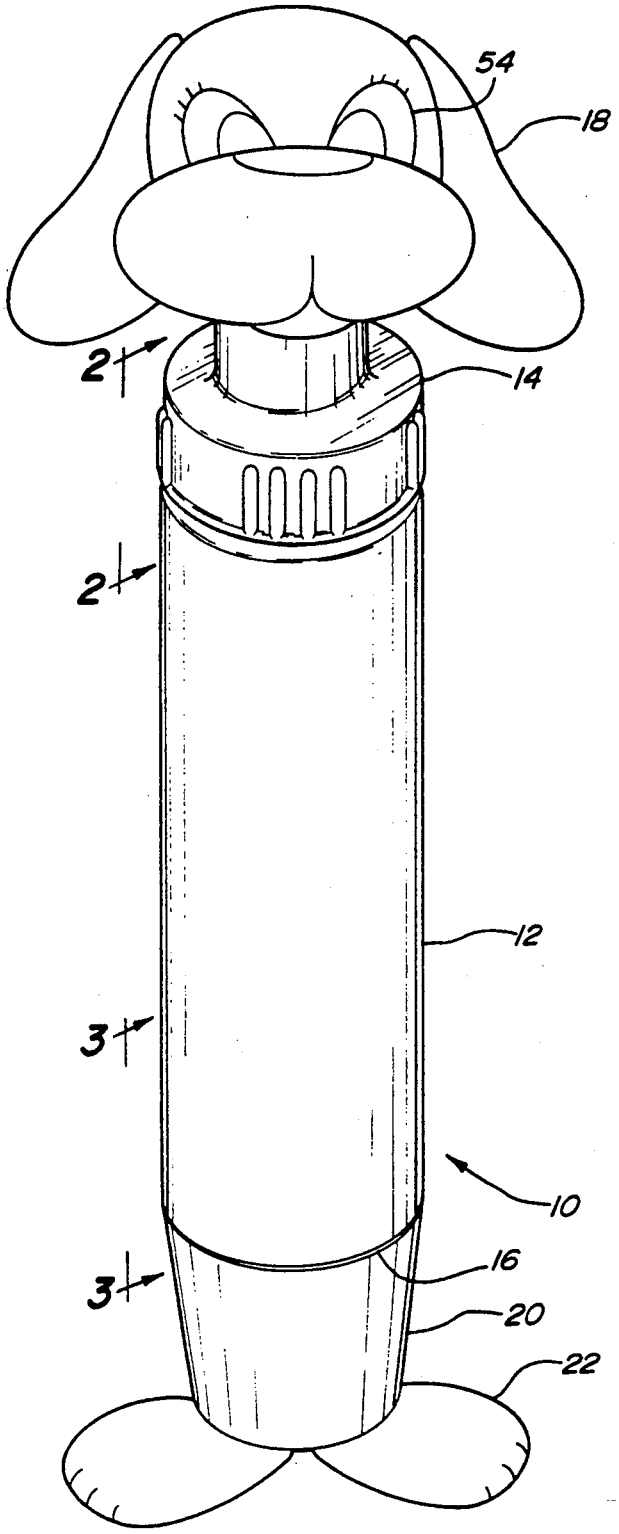
FIG. 1 is a front elevational view of the baby bottle structure with the head and feet of the doll attached to the structure according to the present invention associated therewith.

The drawing discloses the preferred embodiment of the present invention. While the configurations according to the illustrated embodiments are preferred, it is envisioned that alternate configurations of the present invention may be adapted without deviating from the invention as portrayed. The preferred embodiment is discussed hereafter.

With reference to FIG. 1, a baby bottle structure 10 forming a doll is there shown. The baby bottle structure 10 comprises a central fluid receptacle 12 having a nipple portion 14 at one end and a bottom portion 16 at the opposite end.

A top portion 18 is removably attached to the nipple portion 14 of the receptacle 12 and forms the head of a toy, preferably a doll. A base portion 20 is removably attached to the bottom portion 16 of the receptacle 12 and forms the feet of a doll. As shown in FIG. 1, the feet 22 of the doll support the baby bottle structure 10 in an upright position, preventing the baby bottle structure 10 from being easily tipped over.

Figure 2:
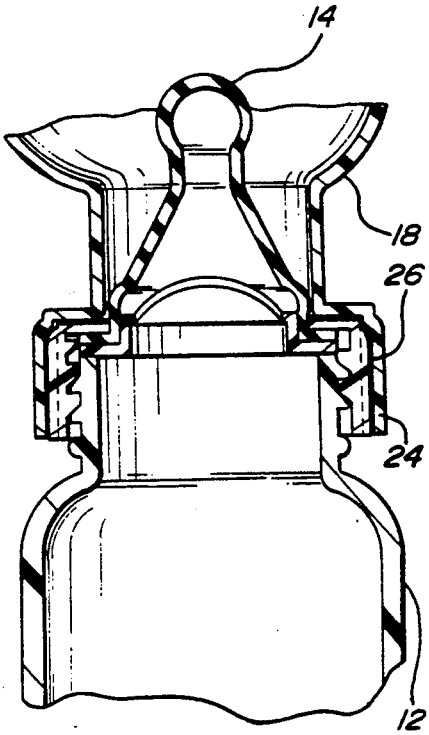
FIG. 2 is a cross-sectional view showing the head of the doll attached about the nipple structure of the baby bottle.

With reference to FIG. 2, a sectional view of the nipple portion 14 of the baby bottle structure 10 is there shown. The head of the doll, top portion 18, is readily removable from the nipple portion 14 by snap-fitting the base 24 of the top portion 18 about the neck 26 of the nipple portion 14. As is more clearly shown in FIG. 4, the base 24 comprises ribs 28 matching ribs 30 on neck 26 to ensure a snap-fit of top portion 18 over nipple portion 14. Other means may be provided for attaching top portion 18 about the nipple portion 14, such as providing means for screwing the top portion 18 to the neck portion 26.

Figure 3:
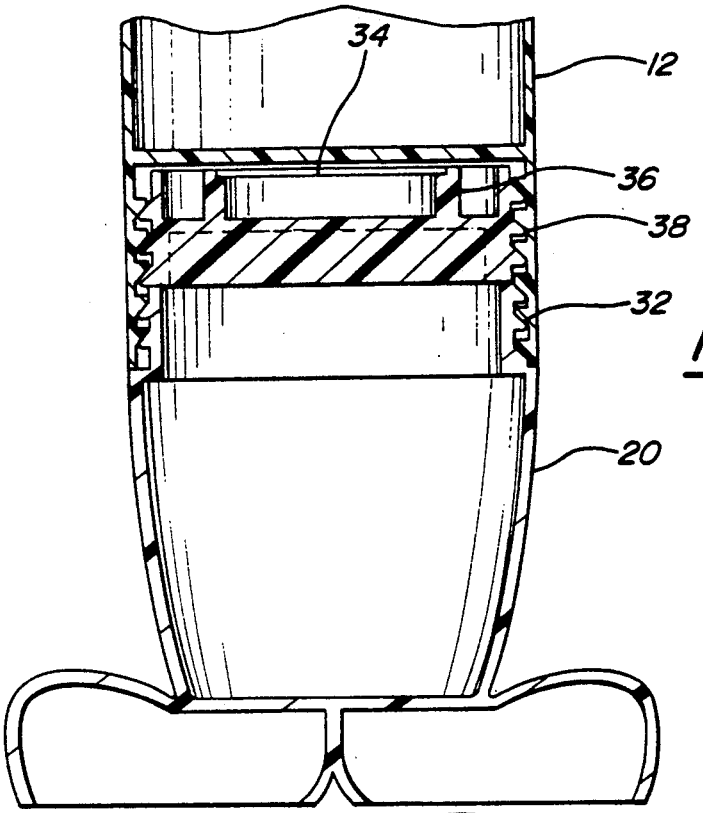
FIG. 3 is a sectional view of the base of the structure showing the feet of the doll attached to the bottom of the bottle and including a music module of the present invention.
Figure 4:
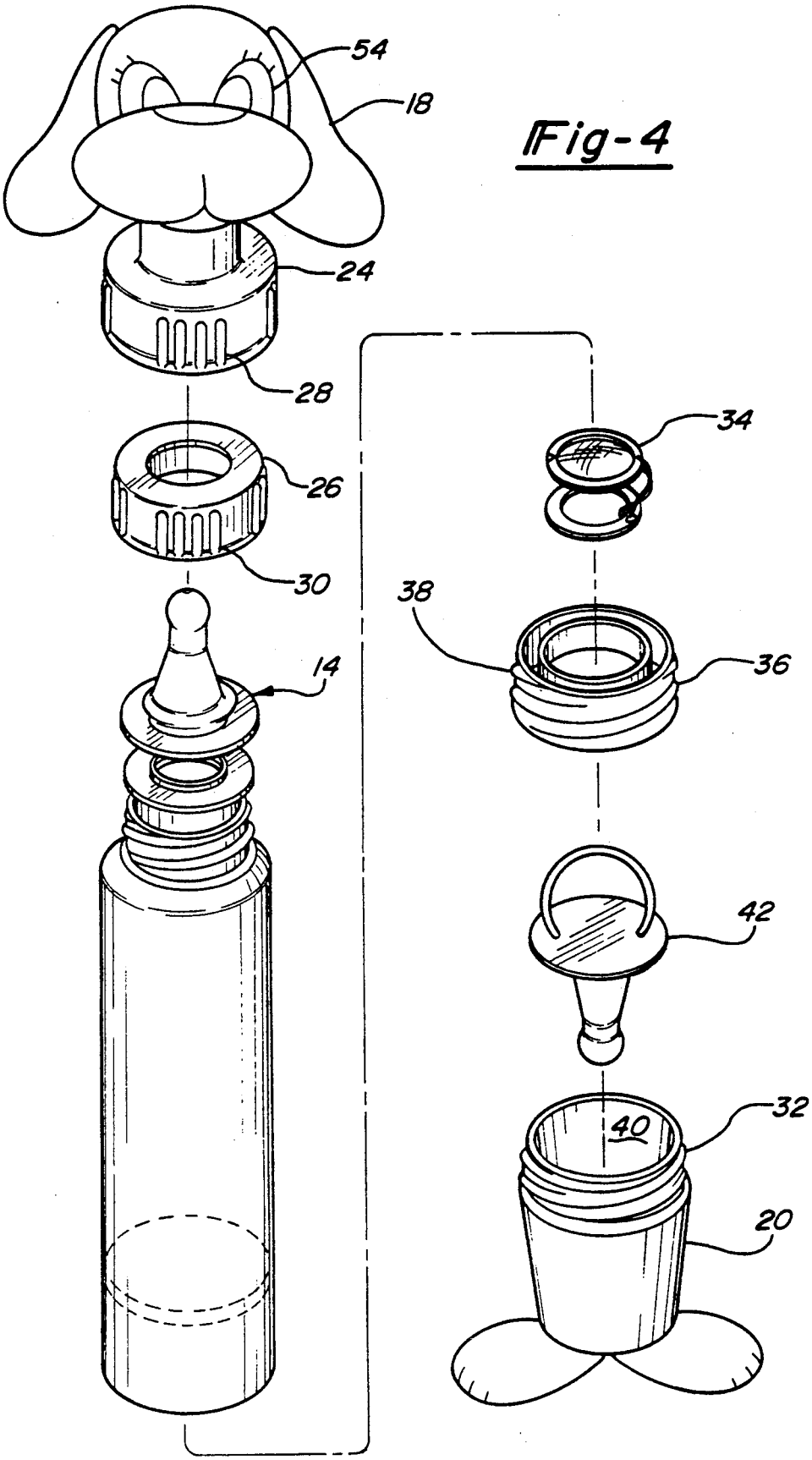
FIG. 4 is an exploded view of the baby bottle structure of the present invention.

With reference now to FIGS. 3 and 4, base portion 20 is there shown removably mounted to contracted fluid receptacle 12 by screw means 32. Music module 34 is provided within the base portion 20 and supported within a housing 36.

Housing 36 provides separate screw means 38 for detachably removing the music module 34 from within the base portion 20. Thus, the music module 34 is easily replaceable to provide different tunes if desired.

Base portion 20 comprises a hollow structure having a cavity 40 for housing a pacifier 42. Base portion 20 may be removed from the central fluid receptacle 12 allowing access to the pacifier 42. Thus, the base portion 20 may be provided interchangeably with music module 34 and pacifier 42 as shown in FIG. 4.

Figure 5:
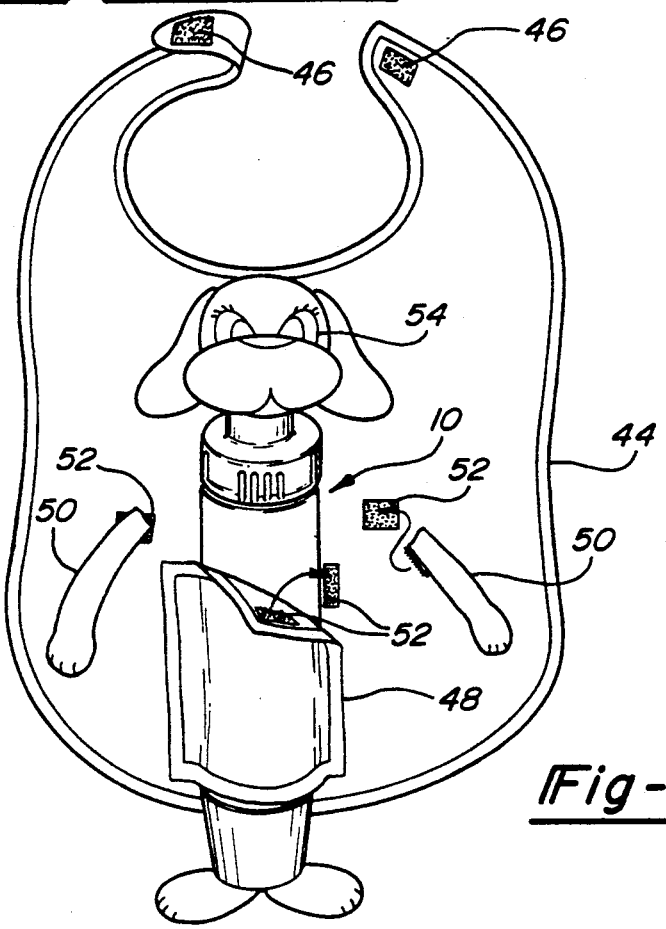
FIG. 5 is a front view of a preferred embodiment of the present invention.

With reference now to FIG. 5, baby bottle structure 10 is there shown removably attached to a bib 44. Bib 44 provides means for supporting a baby bottle structure 10 about an infant. Bib 44 is preferably attached about an infant's neck by attaching means provide data 46, such as VELCRO®.

Baby bottle structure 10 is removably attached to bib 44 by receptacle 48. Receptacle 48 is preferably in the form of doll's clothing, such as a dress or coat.

Rattles 50 may be provided as removably attachable to the bib 44 and form arms of the doll. Clothing 48 and rattles 50 may be removably attached to the bib 44 by attaching means such as VELCRO ®. In this way, the bib 44 and clothing 48 provide means for stabilizing the baby bottle structure 10. This allows an infant to reach for the bottle and feed him or herself without the aid of an adult. Since the baby bottle structure 10 is attached to the bib 44 by clothing means 48, the bottle also provides entertaining means for the infant.

The baby bottle structure 10 may be removed from the bib 44 and used as a toy where the clothing 48 may be removably attachable to the baby bottle structure 10 itself. Further, clothing 48 may be provided with means for attaching rattles 50 directly to the clothing 48. In this way, the baby bottle structure 10 may provide a doll for playing independent of the bib 44. Further, top portion 18, comprising the head of the doll, may comprise rotatable eyes 54, if desired. Eyes 54 will rotate upon tilting of the baby bottle structure 10. Tilting of the baby bottle structure 10 simultaneously activates the music module 34 and rotation of eyes 54. As can be seen from above, the baby bottle structure 10 provides several forms of amusement for an infant while aiding the infant in his/her ability to feed him or herself without the aid of an adult.

Having described my invention, however, many modifications thereto will become apparent to those skilled in the art to which it pertains without deviation from the spirit of the invention as defined by the scope of appended claims.

I claim:

1. A baby bottle structure forming a doll for use by a baby comprising:

central housing forming the body portion of said doll;

top portion removably attached to an end of said central portion and forming the head of said doll;

base portion removably attached to an end of said central portion opposite said top portion, said base portion forming the feet of said doll;

means for supporting said doll about a baby;

said support means comprising:

a bib;

a receptacle removably attached to said bib and supporting said bottle on said bib, said receptacle forming clothing for said doll; and at least one rattle removably attached to said support means and forming at least one arm of said doll.

2. The invention as defined in claim 1 further comprising an intermediate portion removably attached to said base portion and comprising means for generating music.

3. The invention as defined in claim 2 wherein said music generating means comprises a module that is activated by tilting said baby bottle structure.

4. The invention as defined in claim 1, said base portion further comprising a pacifier removably mounted within said base.

5. The invention as defined in claim 1, wherein said top portion further comprises eyes rotatable within said doll head.

* * * * *